US007508115B2

(12) United States Patent
Kawada et al.

(10) Patent No.: US 7,508,115 B2
(45) Date of Patent: Mar. 24, 2009

(54) HORN, HORN UNIT, AND BONDING APPARATUS USING SAME

(75) Inventors: Norihiko Kawada, Tokyo (JP); Yuji Saito, Tokyo (JP); Masakazu Nakayama, Tokyo (JP); Toru Mizuno, Tokyo (JP); Toshinobu Miyagoshi, Tokyo (JP); Junichi Kamata, Kawasaki (JP)

(73) Assignee: TDK Corporation, Tokyo (JP)

( * ) Notice: Subject to any disclaimer, the term of this patent is extended or adjusted under 35 U.S.C. 154(b) by 11 days.

(21) Appl. No.: 11/640,378

(22) Filed: Dec. 18, 2006

(65) Prior Publication Data

US 2007/0144680 A1 Jun. 28, 2007

(30) Foreign Application Priority Data

Dec. 28, 2005 (JP) ..... P2005-378092
Dec. 28, 2005 (JP) ..... P2005-378099
Dec. 28, 2005 (JP) ..... P2005-378101

(51) Int. Cl.
*H04R 1/00* (2006.01)

(52) U.S. Cl. ..... 310/323.19; 310/323.11; 310/323.01

(58) Field of Classification Search ..... 310/323.19, 310/326

See application file for complete search history.

(56) References Cited

U.S. PATENT DOCUMENTS 7,156,201 B2 * 1/2007 Peshkovskiy et al. ..... 181/175
2006/0090956 A1 * 5/2006 Peshkovskiy et al. ..... 181/249

FOREIGN PATENT DOCUMENTS

| | | | |
|---|---|---|---|
| JP | 11307598 | * | 4/1999 |
| JP | A 11-307598 | | 11/1999 |
| JP | A 2002-329752 | | 11/2002 |
| JP | B2 3374856 | | 11/2002 |
| JP | B2 3409688 | | 3/2003 |
| JP | A 2003-124269 | | 4/2003 |
| JP | B2 3487306 | | 10/2003 |
| JP | A 2003-332394 | | 11/2003 |
| JP | B2 3617485 | | 11/2004 |
| JP | A-2004-349655 | | 12/2004 |
| JP | 2005-026500 | | 1/2005 |
| JP | A-2005-311103 | | 11/2005 |
| JP | A-2007-180332 | | 7/2007 |
| JP | A-2007-180333 | | 7/2007 |
| JP | A-2007-180334 | | 7/2007 |

* cited by examiner

*Primary Examiner*—Quyen P Leung
*Assistant Examiner*—Bryan P Gordon
(74) *Attorney, Agent, or Firm*—Oliff & Berridge, PLC

(57) ABSTRACT

A horn that can suppress oscillation components other than the component in the horizontal direction, a horn unit, and a bonding apparatus using same are provided. The horn has a cross-section variable section in which a cross section perpendicular to the lengthwise direction (X direction) thereof has a first region extending in the Z direction and a pair of second regions sandwiching the first region from Y direction. In the position P3 corresponding to an anti-node of a standing wave of oscillations excited in the horn, a sectional area $S_1$ of the first region assumes a maximum and a sectional area $S_2$ of the second region assumes a minimum. With a transition from the position P3 to the other positions corresponding to nodes, the sectional area $S_1$ decreases and the sectional area $S_2$ increases. As a result, oscillation components other than those in the X direction are suppressed.

4 Claims, 9 Drawing Sheets

HORN, HORN UNIT, AND BONDING APPARATUS USING SAME

BACKGROUND OF THE INVENTION

1. Field of the Invention

The present invention relates to a horn, a horn unit, and a bonding apparatus using same.

2. Description of the Related Art

A conventional horn relating to this technical field is disclosed, for example, in Japanese Patent No. 3409688. The horn described in this open publication is designed to bond ultrasonically an electronic component equipped with bumps, such as a flip chip, to a substrate by applying oscillations to the electronic component, in a state where the horn holds the electronic component.

SUMMARY OF THE INVENTION

When a horn is used for ultrasonically bonding an electronic component, it is preferred that the electronic component held by the horn be caused to oscillate in the horizontal direction. However, with the aforementioned conventional horn, it is impossible to excite oscillations in which the oscillation components other than the component in the horizontal direction are sufficiently suppressed.

Accordingly, the present invention was created to resolve the aforementioned problem and it is an object of the present invention to provide a horn that can suppress oscillation components other than the component in the horizontal direction, a horn unit, and a bonding apparatus using same.

The horn in accordance with the present invention is a horn to which oscillations are applied by an oscillator, this horn having a portion in which a cross section perpendicular to the lengthwise direction of the horn has a first region extending in one direction and a pair of second regions sandwiching the first region from the direction perpendicular to the first direction, in a position corresponding to an anti-node of a standing wave of oscillations excited in the horn, a sectional area of the first region assumes a maximum and a sectional area of the second region assumes a minimum, and with a transition from the position corresponding to an anti-node of the standing wave to a position corresponding to a node, the sectional area of the first region decreases and the sectional area of the second region increases.

The inventors have discovered that with a horn having the portion in which in a position corresponding to an anti-node of a standing wave of oscillations excited in the horn, the sectional area of the first region assumes a maximum and the sectional area of the second region assumes a minimum, and with a transition from the position corresponding to an anti-node of the standing wave to a position corresponding to a node, the sectional area of the first region decreases and the sectional area of the second region increases, oscillation components other than those in the horizontal direction are suppressed.

The sectional area of the first region may be decreased by narrowing the first region in one direction, and the sectional area of the second region may be increased by expanding the second region in one direction.

The horn unit in accordance with the present invention comprises a horn to which oscillations are applied by an oscillator, this horn comprising a portion in which a cross section perpendicular to the lengthwise direction of the horn has a first region extending in one direction and a pair of second regions sandwiching the first region from the direction perpendicular to the first direction, in a position corresponding to an anti-node of a standing wave of oscillations excited in the horn, a sectional area of the first region assumes a maximum and a sectional area of the second region assumes a minimum, and with a transition from the position corresponding to an anti-node of the standing wave to a position corresponding to a node, the sectional area of the first region decreases and the sectional area of the second region increases, and a horn holder joined to the horn in a position corresponding to a node of the standing wave of the horn. Because the horn holder has the above-described horn unit, oscillation components in the directions other than the horizontal direction are suppressed.

The bonding apparatus in accordance with the present invention comprises an oscillator for applying oscillations to a horn, a horn unit comprising a horn to which oscillations are applied by an oscillator, this horn having a portion in which a cross section perpendicular to the lengthwise direction of the horn has a first region extending in one direction and a pair of second regions sandwiching the first region from the direction perpendicular to the first direction, in a position corresponding to an anti-node of a standing wave of oscillations excited in the horn, a sectional area of the first region assumes a maximum and a sectional area of the second region assumes a minimum, and with a transition from the position corresponding to an anti-node of the standing wave to a position corresponding to a node, the sectional area of the first region decreases and the sectional area of the second region increases, and a horn holder joined to the horn in a position corresponding to a node of the standing wave of the horn, and pressurization means for performing pressurization control in the one direction of the horn. Because the bonding apparatus has the above-described horn unit, oscillation components in the directions other than the horizontal direction are suppressed.

In accordance with the present invention, there are provided a horn, a horn unit, and a bonding apparatus using same in which oscillation components in the directions other than the horizontal direction are suppressed.

DESCRIPTION OF THE PREFERRED EMBODIMENTS

The preferred modes for carrying out the present invention will be described hereinbelow with reference to the appended drawings. Identical or similar elements with be assigned with identical reference symbols, and the explanation thereof will be omitted to avoid redundancy.

(Bonding Apparatus)

Figure 1:
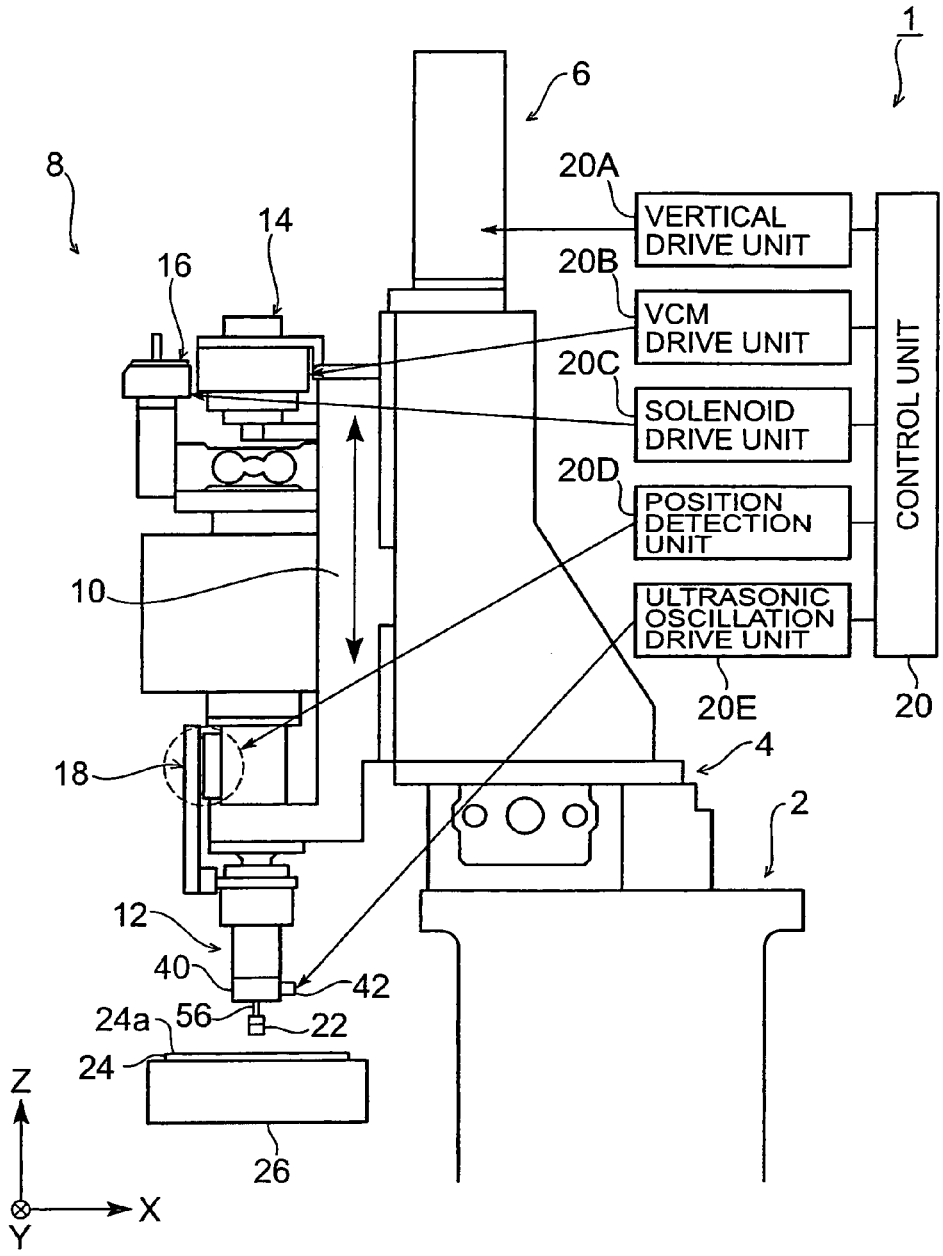
FIG. 1 is a schematic structural drawing illustrating a bonding apparatus of an embodiment of the present invention.

FIG. 1 shows a bonding apparatus 1 of an embodiment of the present invention. The bonding apparatus 1 is an apparatus for mounting electronic components on a mounting substrate by ultrasonic bonding. The apparatus has an Y table 4 carried on a pedestal frame 2, a Z axis servo motor 6 (a vertical drive unit 20A) that is driven by the Y table 4 in the horizontal direction, and a bonding unit 8 that is moved by the Z axis servo motor 6 in the vertical direction.

The bonding unit 8 comprises a vertical movement block 10, a bonding head 12 that is held with a freedom of movement in the vertical direction on the vertical movement block 10, a voice coil motor 14 (a VCM drive unit 20B) that controls a load applied by the bonding head 12 to press bond an electronic component 22 to a bonding surface 24*a* of the mounting substrate 24, a lock solenoid 16 (a solenoid drive unit 20C) that regulates the vertical movement of the bonding head 12 with respect to the vertical movement block 10, and a linear scale 18 (a position detection unit 20D) that detects the position of the bonding head 12 in the Z axis direction. Further, the bonding head 12 serves to hold the electronic component 22 and cause the oscillations thereof, while pressure attaching the electronic component 22 to the pressure attachment surface 24*a* of the mounting substrate 24. The bonding head comprises the below-described oscillator 42 (an ultrasonic oscillation drive unit 20E).

The vertical drive unit 20A, VCM drive unit 20B, solenoid drive unit 20C, position detection unit 20D, and ultrasonic oscillation drive unit 20E are controlled by the control unit 20. This control unit 20 comprises a CPU, a ROM, a RAM, an A/D converter, and a variety of I/F, performs operation processing of various types according to a predetermined program based on information of various types such as input signals from the position detection unit 20D, and, for example, other input signals or stored values, sends drive signals to the vertical drive unit 20A, VCM drive unit 20B, solenoid drive unit 20C, and the like, controls the drive of those units, and also sends a drive unit to the ultrasonic oscillation drive unit 20E and controls the drive of the oscillator 42.

A camera (not shown in the figure) for performing position detection of structural elements can be provided in a predetermined location at the bonding apparatus 1.

The operation of ultrasonic bonding with the bonding apparatus 1 is performed according to the below-described procedure.

(1) First, a lock solenoid 16 that is integrally attached to the vertical movement block 10 is driven and the vertical movement of the bonding head 12 is regulated. In this state, the Z axis servo motor 6 and bonding unit 8 are moved integrally by the Y table 4, and the electronic component 22 is aligned in the horizontal direction with respect to the substrate 24 located on the substrate stage 26.

(2) Then, the Z axis servo motor 6 is driven, the bonding unit 8 is lowered, and the electronic component 22 held by the bonding head 12 is lowered to a contact detection start position. An electric current supplied to the voice coil motor 14 is then set and the lock solenoid 16 is opened so that the load applied when the electronic component 22 comes into contacts with the substrate 24 assumes a set value.

More specifically, the value of electric current (that is, a torque generated by the voice coil motor 14) that is supplied to the voice coil motor 14 is set so that the load acting upon the electronic component 22 held by the bonding head 12 assumes a set value (for example, about 10-100 g) when the electronic component comes into contact with the substrate 24. In other words, "Set value"="Bonding head weight"+"Voice coil motor torque". When the load applied to the bonding head 12 is equal to or higher than the set value, the voice coil motor 14 generates a torque in the upward direction (lifting torque) as shown in FIG. 1. In other words, for example, the following settings are used. Thus, if "Set value (that is, a load allowed when the electronic component is in contact with the substrate)"=50 g and "Bonding head weight"=1000 g, then the setting is:

"Bonding motor torque"=−950 g (lifting torque acting upward as shown in FIG. 1). Thus, the voice coil motor (pressurizing means) 14 performs a pressurization control in the direction of pressure attachment (Z direction) of the below-described horn 50.

(3) The Z axis servo motor 6 is further driven and the vertical movement block 10 is lowered until the electronic component 22 held by the bonding head 12 comes into contact with the substrate 24. If the electronic component 22 comes into contact with the pressure attachment surface 24*a* of the substrate 24, the bonding head 12 that followed the descending operation of the vertical movement block 10 stops in this position and only the vertical movement block 10 continues to descend. As a result, the bonding head 12 separates from the vertical movement block 10 to which it was heretofore linked and assumes a floating state. The linear scale 18 detects this change (that is, the start of the contact of the electronic component and substrate).

By so detecting the start of contact of the electronic component 22 held by the bonding head 12 and the substrate 24 located on the substrate stage 26 by using the linear scale 18, the contact start can be detected with higher accuracy, while maintaining the detection stability at a higher level than in the case where the start of the contact of the electronic component 22 with substrate 24 is detected based on the detection value of the drive current of the motor or the detection value of a load cell.

(4) If the vertical movement block 10 is lowered after the electronic component 22 came into contact with the substrate 24, only the vertical movement block 10 continues the descending operation, but such descending operation of the vertical movement block 10 is continued only through the predetermined feed amount (for example, about 300 μm).

(5) The electronic component 22 is caused to oscillate by driving the oscillator 42, and the electronic component 22 is ultrasonically bonded to the substrate 24. The contact pressure between the electronic component 22 and substrate 24 can be controlled to a predetermined target value by monitoring the output value of the linear scale 18 and adjusting the drive force of the voice coil motor 14, while the ultrasonic bonding is being conducted.

(6) Upon completion of the ultrasonic bonding, the Z axis servo motor 6 is driven and the bonding head 12 is raised to a contact detection start position.

(7) The lock solenoid is driven to regulate the free movement of the bonding head 12.

(8) The Z axis servo motor 6 is then driven, the vertical movement block 10 is raised to the predetermined standby position, and the mounting operation is completed.

(Bonding Head)

The aforementioned bonding head 12 will be described below in greater detail.

Figure 2:
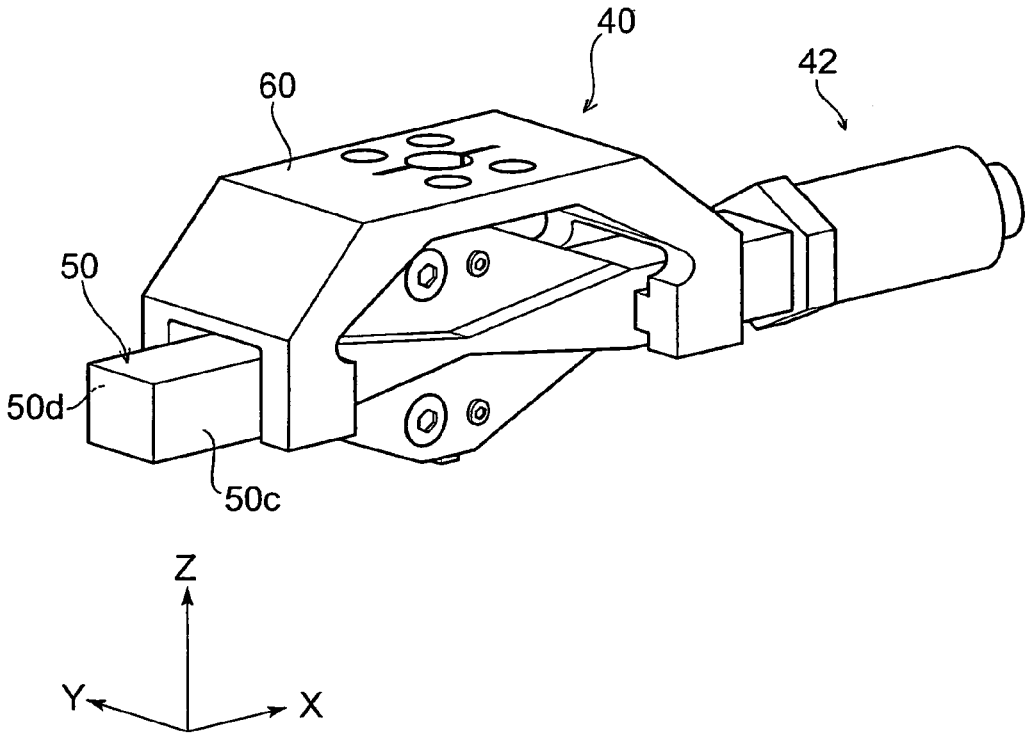
FIG. 2 is a perspective view illustrating a horn unit of the bonding apparatus of FIG. 1.
Figure 3:
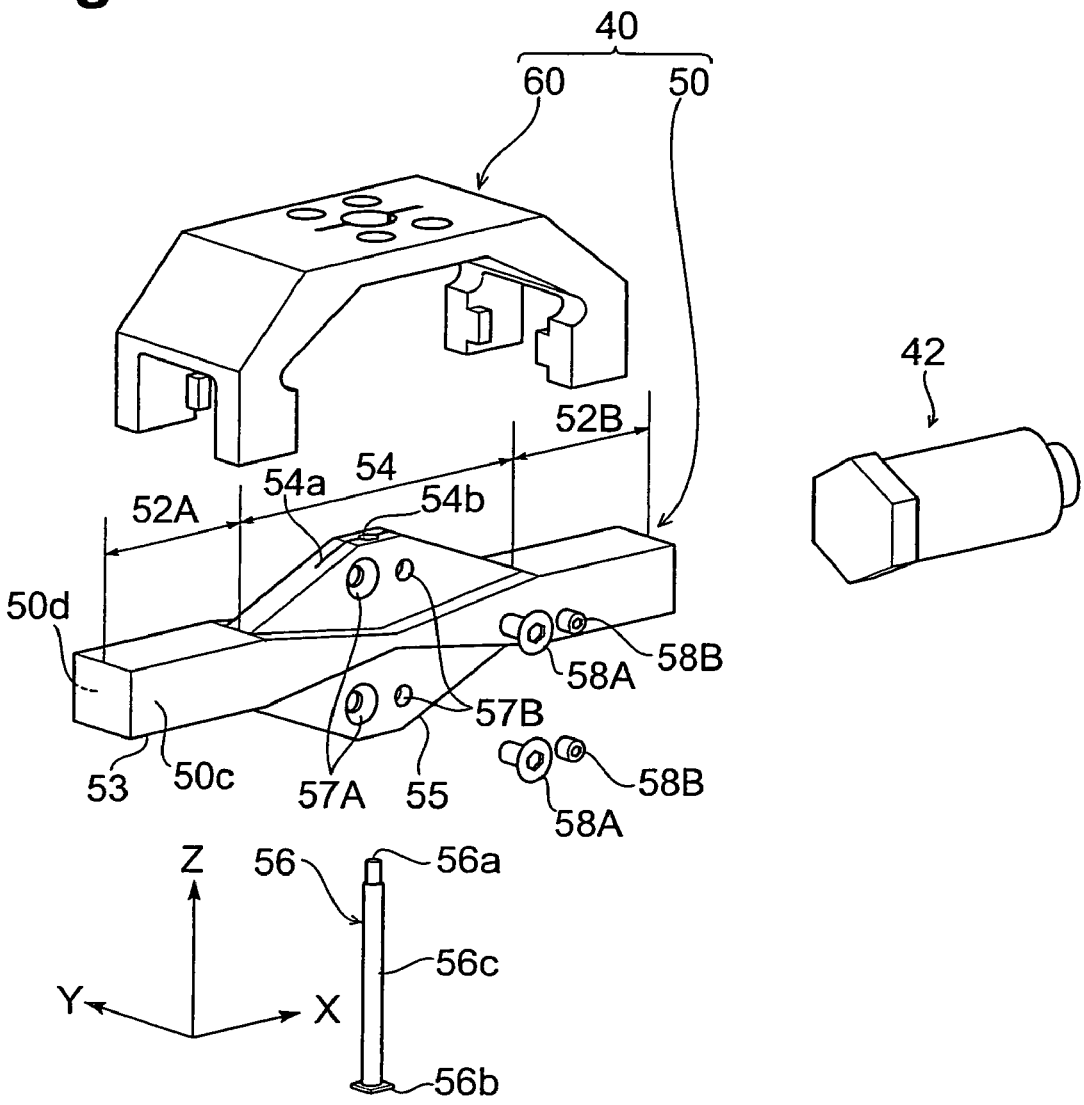
FIG. 3 is an exploded perspective view of the horn unit shown in FIG. 2.

The bonding head 12 has in the lower section thereof a horn unit 40 and the oscillator 42 attached to the horn unit 40. The electronic component 22 is held by the horn unit 40, and oscillations are applied to the electronic component 22 by the oscillator 42 via the horn unit 40. In the horn unit 40, as shown in FIG. 2 and FIG. 3, an elongated horn 50 from stainless steel SUS and a horn holder 60 from stainless steel SUS that holds the horn 50 are formed integrally.

(Horn)

A standing wave excited in the horn 50 has a wavelength (λ) matching the total length (L) (for example, 80 mm) in the lengthwise direction of the horn 50. The positions of a distal end surface 50*a* and a rear end surface 50*b* of the horn 50 are corresponding to anti-nodes of the standing wave. If the position of the distal end surface 50*a* is denoted by as P1 and the positions spaced by λ/4 along the lengthwise direction from P1 are denoted by P2, P3, P4, and P5, then P1, P3, P5 will be the positions corresponding to the anti-nodes of the standing wave, and P2 and P4 will be the positions corresponding to the nodes of the standing wave. In other words, in theory, the amplitude of the standing wave is maximum in the P1, P3, and P5 positions and the amplitude of the standing wave is zero in the P2 and P4 positions. The total length (L) of the above-described horn 50 is $$L=\lambda,$$

but may be also changed appropriately to L represented by the general formula:

$$L=\lambda+m\lambda/2 \text{ (}m\text{: natural number).}$$

In the present specification, for the sake of convenience, the lengthwise direction of the horn 50 will be defined as the X direction, the pressure attachment direction of the horn 50 will be defined as the Z direction, and the direction perpendicular to the X direction and Z direction will be defined as the Y direction.

Figure 4:
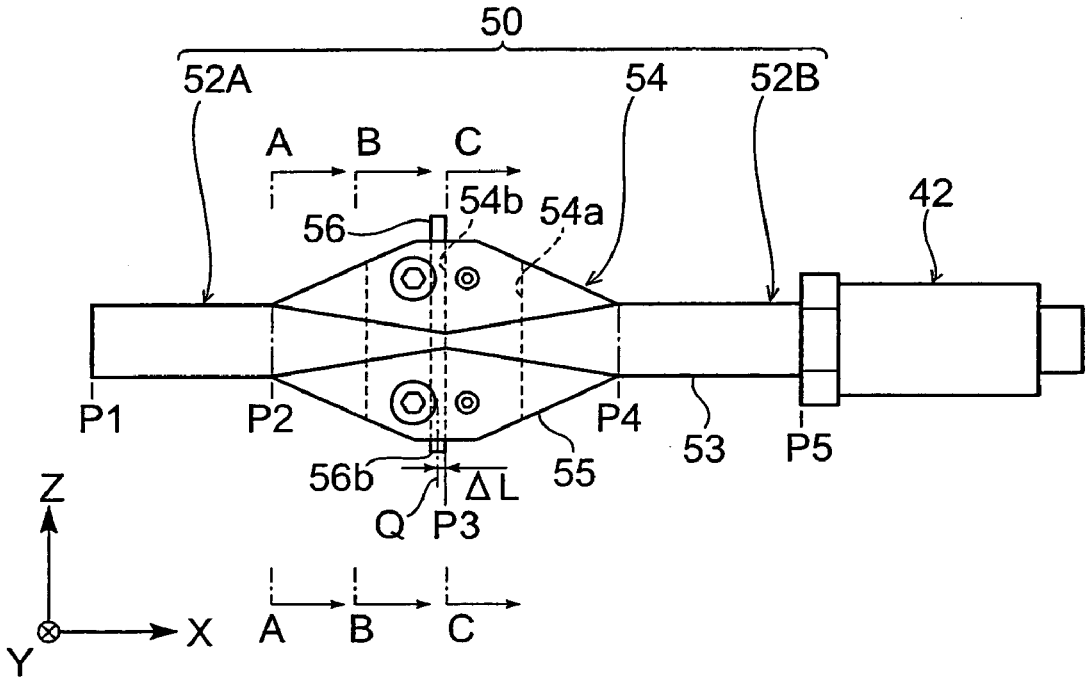
FIG. 4 is a side view of the horn unit shown in FIG. 2.
Figure 5:
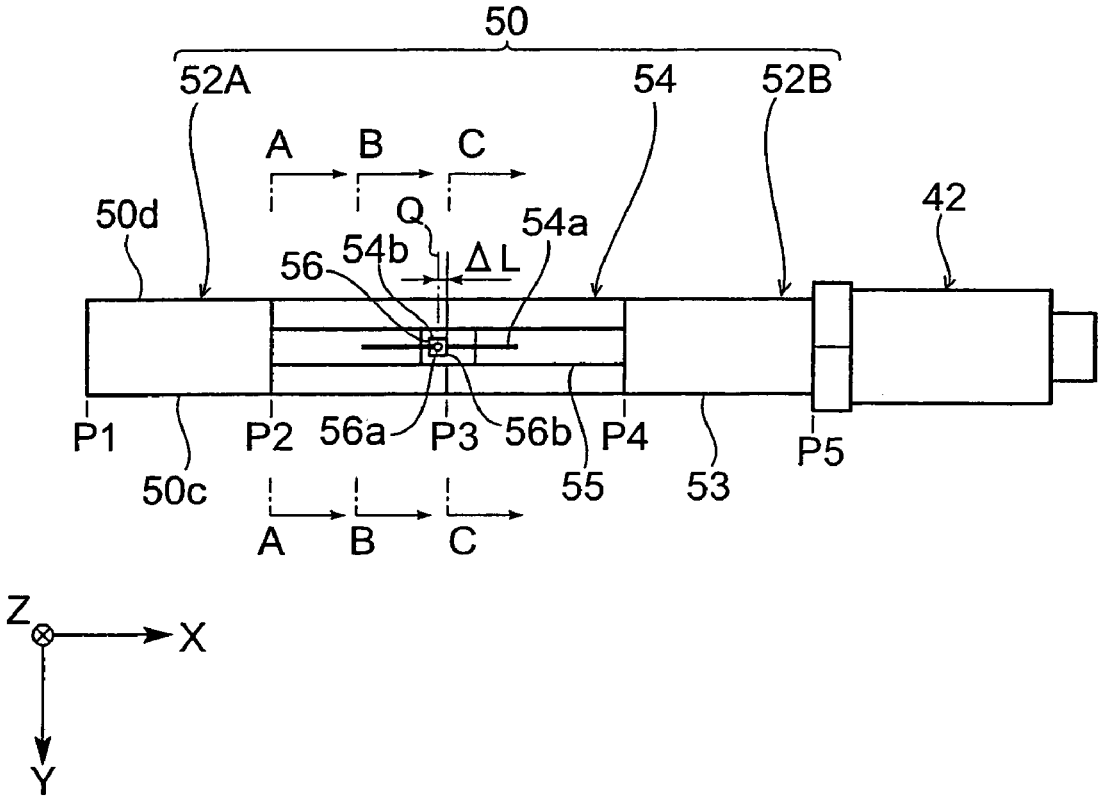
FIG. 5 is a bottom view of the horn unit shown in FIG. 2.

As shown in FIG. 4 and FIG. 5, the horn 50 comprises a cross-section invariable section 52A that is a portion between P1 and P2 and has a cross-sectional shape that does not vary, a cross-section variable section 54 that is a portion between P2 and P4 and has a variable cross section, and a cross-section invariable section 52B that is a portion between P4 and P5 and has a variable cross section. Furthermore, the horn 50 has a substantially symmetrical shape with respect to the P3 position.

The cross-section invariable sections 52A, 52B have a length of λ/4 each, and the cross section thereof is the same regardless of the position in the lengthwise direction (X direction) of the horn 50. More specifically, the cross-sectional shape of the cross-section invariable sections 52A, 52B is a square in which the length (width) in the Y direction is the same as the length (height) in the Z direction.

Figure 6:
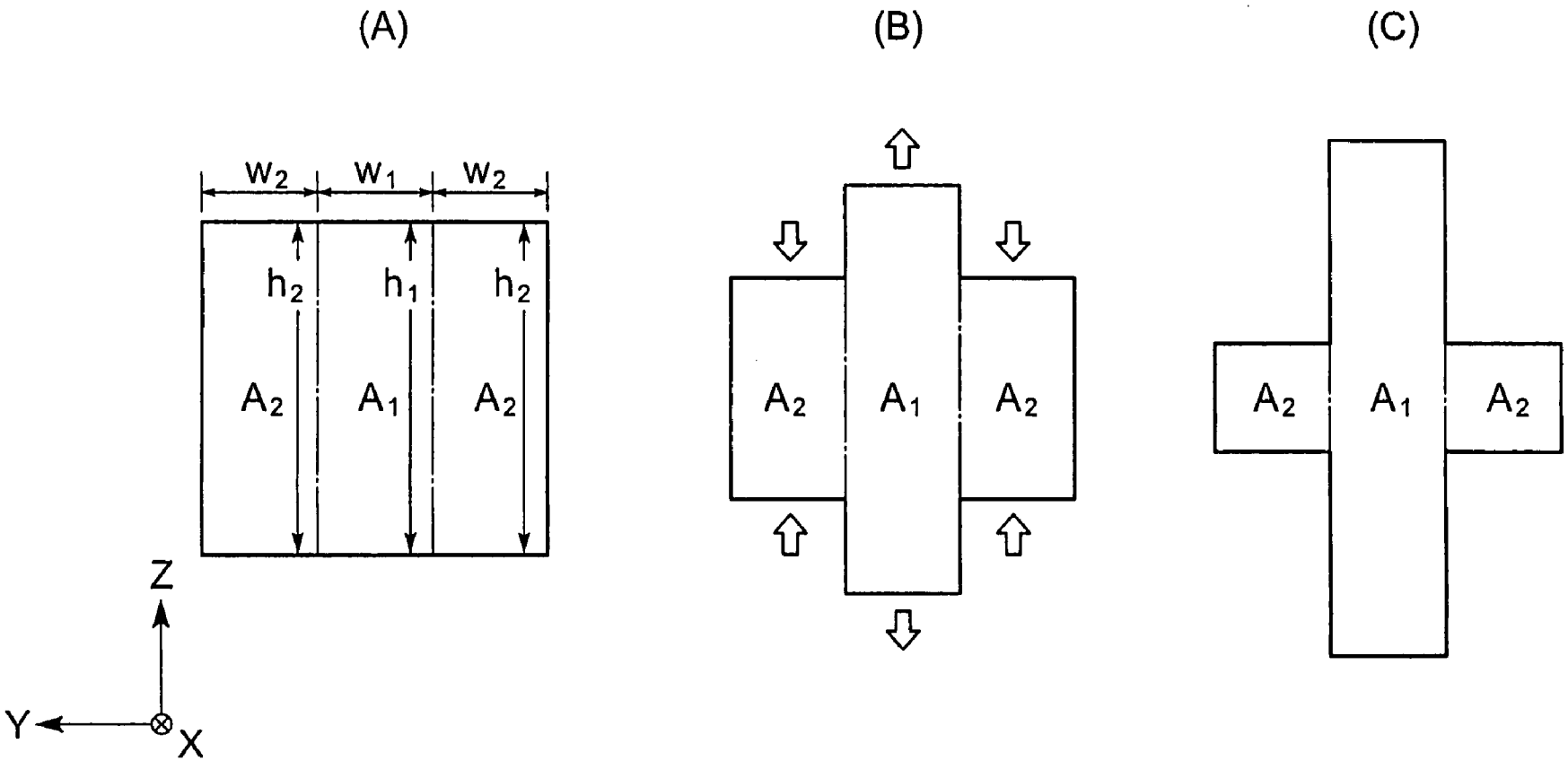
FIG. 6 is a cross-sectional view of the horn of the horn unit shown in FIG. 2.

The cross-section variable section 54 has a length of λ/2, and the cross section thereof varies depending on the position in the X direction, as shown in FIG. 6. In FIG. 6, the (A) portion is a cross section along the A-A line in FIG. 4 and FIG. 5, the (B) portion is a cross section along the B-B line in FIG. 4 and FIG. 5, and the (C) portion is a cross section along the C-C line in FIG. 4 and FIG. 5. In other words, the (A) portion of FIG. 6 is a cross-sectional view in P2, the (C) portion of FIG. 6 is a cross-sectional view in P3, and the (B) portion of FIG. 6 is a cross-sectional view in a position between P2 and P3.

Here, explaining the cross-sectional shape of the cross-section variable section 54, the external cross-sectional shape of the cross-section variable section 54 is divided into a first region A1 and a second region A2. The first region A1 is a square-shaped region extending in the Z direction. The second region A2 is a pair of square-shaped regions sandwiching the first region A1 from the direction (Y direction) perpendicular to the X direction. The height of the first region A1 and second region A2 is denoted by $h_1$, $h_2$, respectively, the width of the first region A1 and second region A2 is denoted by $w_1$, $w_2$, respectively, and the sectional area of the first region A1 and second region A2 is denoted by $S_1$ ($=h_1 \cdot w_1$) and $S_2$($=h_2 \cdot w_2$), respectively.

As shown in the (A) portion of FIG. 6, the cross section of the cross-section variable section 54 in P2 has a square shape similarly to the cross-sectional shape of the cross-section invariable sections 52A, 52B. Thus, the height $h_1$ of the first region A1 is equal to the height $h_2$ of the second region A2.

In the cross section of the cross-section variable section 54 between P2 and P3, as shown in the (B) portion of FIG. 6, the first region A1 has a height $h_1$ larger than that of the first region A1 in P2, while the width $w_1$ thereof is unchanged. Therefore, the sectional area $S_1$ of this cross section increases over that of the first region A1 in P2. On the other hand, in the cross section of the cross-section variable section 54 between P2 and P3, the second region A2 has a height $h_2$ smaller than that of the second region A2 in P2, while the width $w_2$ thereof is unchanged. Therefore, the sectional area $S_2$ of this cross section decreases with respect to that of the second region A2 in P2.

In the cross section of the cross-section variable section 54 in P3, as shown in the (C) portion of FIG. 6, the first region A1 has a height $h_1$ larger than that of the first region A1 between P2 and P3 and the sectional area $S_1$ of this cross section assumes a maximum. On the other hand, in the cross section of the cross-section variable section 54 in P3, the second region A2 has a height $h_2$ smaller than that of the second region A2 between P2 and P3 and the sectional area $S_2$ of this cross section assumes a minimum.

In other words, in the cross section of the cross-section variable section 54 between P2 and P3, the height $h_1$ of the first region A1 gradually decreases, the sectional area $S_1$ of the first region A1 gradually decreases, the height $h_2$ of the second region A2 gradually increases, and the sectional area $S_2$ of the second region A2 gradually increases with the transition from the position of P3 corresponding to the standing wave anti-node to the position of P2 corresponding to the standing wave node.

Because the cross section variable section 54 is substantially symmetrical with respect to the P3 position, in the cross section of the cross-section variable section 54 between P3 and P4, the sectional area $S_1$ of the first region A1 also gradually decreases and the sectional area $S_2$ of the second region A2 also gradually increases with the transition from the P3 position corresponding to the standing wave anti-node to the P4 position corresponding to the standing wave node.

Thus, in the cross section of the cross-section variable section 54, the sectional area $S_1$ of the first region A1 assumes a maximum and the sectional area $S_2$ of the second region A2 assumes a minimum in the P3 position corresponding to the standing wave anti-node. Furthermore, the sectional area $S_1$ of the first region A1 decreases and the sectional area $S_2$ of the second region A2 increases with the transition from the P3 position corresponding to the standing wave anti-node to the P2, P4 positions corresponding to the standing wave node.

Furthermore, the horn 50, if viewed from the standpoint of width thereof, is composed of a main section 53 with a width of ($w_1+2 \cdot w_2$) and a protruding section 55 with a width of $w_1$. Here, the main section 53 is composed of the above-described cross-section invariable sections 52A, 52B and the cross-section variable section 54 of the portion including the first region A1 and second region A2 in the width direction, and the protruding section 55 is composed of the cross-section variable section 54 of the portion including only the first region A1 in the width direction. Thus, the protruding section 55 is thinner than the main section 53 and protrudes from the main section 53 in the thickness direction of the main section 53.

(Horn Holder)

The horn holder 60 is fixed to the horn 50 in four positions of P2 and P4 at both side surfaces 50*c*, 50*d* perpendicular to the Y direction of the horn 50. Because the horn holder 60 thus holds the horn 50 in the positions P2 and P4 in which the amplitude of the standing wave is theoretically zero, the propagation of the standing wave induced in the horn 50 to the horn holder 60 is effectively suppressed. As a result, the horn 50 can be reliably held by the horn holder 60, and the oscillations that propagated from the horn 50 to the horn holder 60 are prevented from affecting the oscillation mode of the horn 50.

(Oscillator)

The oscillator 42 is a piezoelectric oscillator oscillating at a frequency 60 kHz when a voltage is applied from a power source (not shown in the figure), the oscillator is attached to the rear end surface 50*b* of the horn 50. The oscillator 42 applies the oscillations in the X direction from the rear end surface 50*b* of the horn 50 to the horn 50 and induces the aforementioned standing wave in the horn 50. Further, the oscillator 42 is attached to the horn 50, for example, by providing a male threaded section in the oscillator 42, providing a female threaded section in the rear end surface 50*b* of the horn 50, and screwing the male threaded section into the female threaded section.

(Nozzle)

As shown in FIG. 5, a slit 54*a* passing in the X direction is provided in the protruding section 55 (that is, in the vicinity of the central section of the cross-section variable section 54) of the horn 50, and this slit 54*a* passes through the horn 50 in the Z direction. A through hole for nozzle attachment (nozzle accommodation hole) 54*b* is provided all the way through along the Z direction in the position shifted from the position in the center of the cross-section variable section 54 (that is, P3 position), which is the position where the slit 54*a* is provided, toward the P2 position by a very small length ΔL (offset length). Therefore, this through hole 54*b* crosses the slit 54*a*.

The nozzle 56 made from a superalloy (for example, WC—Co alloy) or SUS is inserted and accommodated in the through hole 54*b*. In the nozzle (pressure attachment nozzle) 56 extending along the through hole 54*b*, an air suction hole 56*a* is provided all the way through along the lengthwise direction (that is, Z direction) of the nozzle. The air suction hole 56*a* is linked to a vacuum device (not shown in the figure) of the bonding apparatus 1, and the nozzle 56 can vacuum hold the electronic component 22 at the lower end surface 56*b* of the nozzle 56 where the vacuum suction hole 56*a* is exposed. The lower end surface 56*b* of the nozzle 56 serves as a surface for actually pressure attaching the electronic component 22 to the substrate 24 (pressure attachment surface). According to the displacement of the through hole 54*b* by the offset length ΔL from the P3 position, the central position of the pressure attachment surface 56*b* is shifted by the offset length ΔL (for example, 1 mm) from the P3 position.

(Adjustment Screw)

As shown in FIG. 3, in the formation region of the slit 54*a* in the protruding section 55 of the horn 50, two threaded port pairs (tightening holes) including release threaded ports 57A and tightening threaded ports 57B are provided in the upper and lower sections through the protruding section 55 in the Y direction. Release screws 58A are screwed into the release threaded ports 57A, and tightening screws (fixing means) 58B are screwed into the tightening threaded ports 57B. Those threaded ports 57A, 577B and screws 58A, 588B serve to expand or narrow the slit 54*a*, and the width of the slit 54*a* of the cross-section variable section 54 can be adjusted by adjusting the screws 58A, 58B.

Furthermore, the diameter of the through hole 54*b* provided in the position of the slit 54*a* is designed to be slightly larger than the diameter of the nozzle 56. Therefore, by decreasing the width of the slit 54*a* via the threaded port pair 57A, 57B with the screws 58A, 58B, the nozzle 56 inserted into the through hole 54*b* can be tightened and fixed (the so-called, split tightening) to the horn 50. In other words, the nozzle 56 is tightly squeezed from the side peripheral surfaces 56*c* thereof in the horn 50 along the entire length of the through hole 54*b*. On the other hand, by increasing the width of the slit 54*a* via the threaded port pair 57A, 57B by the screws 58A, 58B, the nozzle 56 can be removed from the horn 50.

In other words, by adjusting the width of the slit 54*a* with the screws 58A, 58B via the threaded port pairs 57A, 577B and changing the tightening force of the nozzle 56, it is possible to adjust easily the attachment of the nozzle 56 to and disconnection from the horn 50 and adjust the protrusion length of the nozzle 56. In the case where the protrusion length of the nozzle 56 reaches the half-wavelength of the above-described standing wave, the nozzle 56 starts oscillating with a large amplitude and cannot oscillate integrally with the horn 50. For this reason, the protrusion length of the nozzle 56 is set to a length (for example, 1 mm) less than half-wavelength of the standing wave.

(Oscillation Mode of the Horn)

Figure 7:
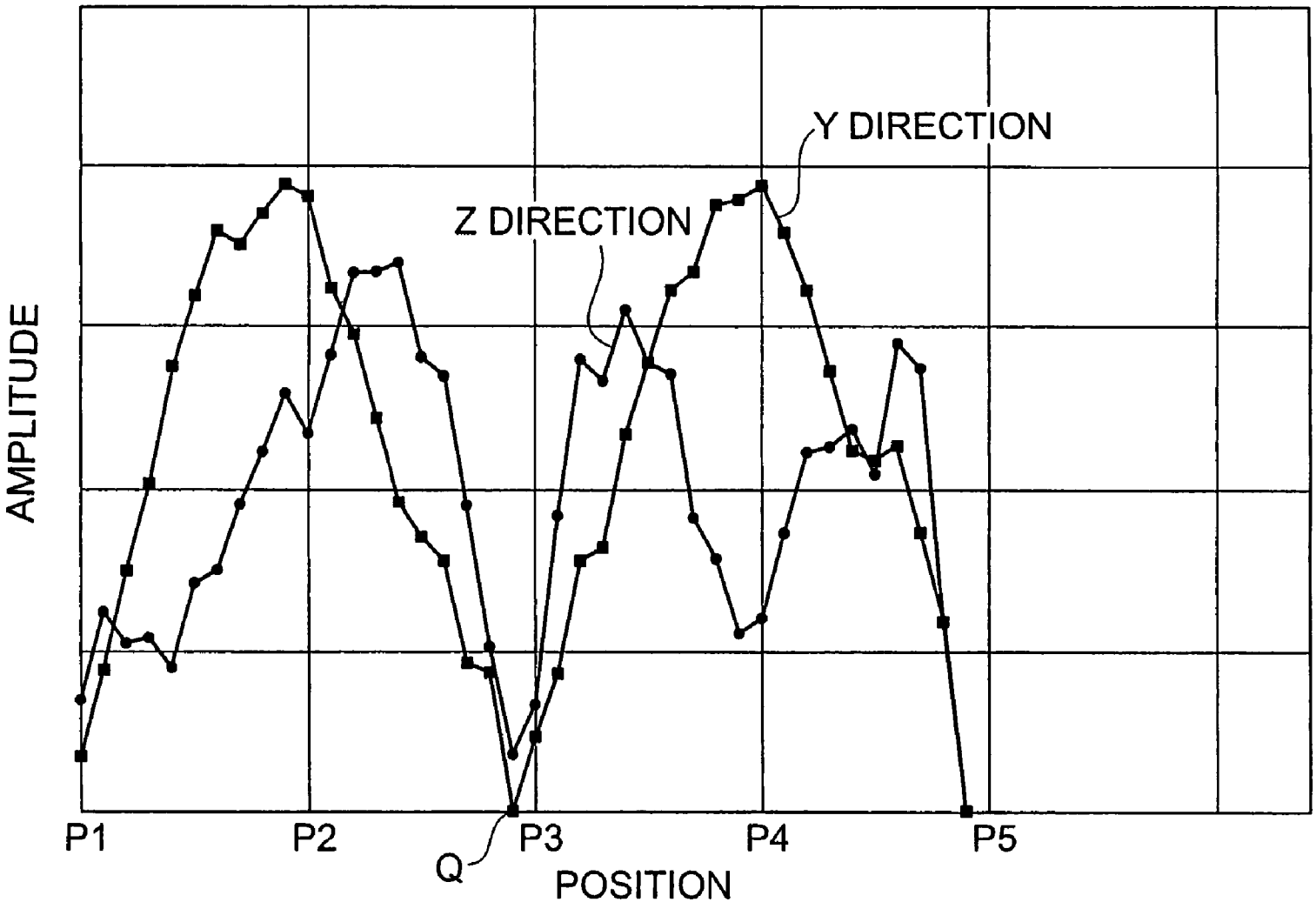
FIG. 7 illustrates an oscillation mode of the horn unit shown in FIG. 2.

The oscillation mode (stationary oscillation mode) of the horn 50 in the case where a standing wave is excited in the horn 50 by the oscillator 42 will be described below with reference to FIG. 7. FIG. 7 is a graph showing an amplitude of the Y direction component and Z direction component of the standing wave in positions P1-P5 of the horn 50.

As clearly shown by the graph of FIG. 7, the amplitude in the Y direction and the amplitude in the Z direction are almost the smallest in the P3 position. In other words, in the P3 position, the amplitudes of the Y direction component and Z direction component of the sanding wave are substantially zero and only the oscillations of the X direction component of the stationary wave are generated.

Further, in the present embodiment the oscillator 42, which is different from the horn 50, is tightly fixed to the rear end surface 50*b* of the horn 50. As a result, the oscillation components in the directions (Y direction and Z direction) different from the oscillation direction (X direction) do not have a distribution symmetrical with respect to the position P3 corresponding to an anti-node of the standing wave. Here, the central position of the pressure attachment surface 56*b* is matched with a position Q in which the Y direction component and Z direction component of the standing wave become extremely small by shifting the central position of the pressure attachment surface 56*b* of the nozzle 56 toward P2 by the offset length ΔL. Here, when the electronic component 22 is pressed against the substrate 24, the oscillations of the Y direction component act so as to rotate the electronic component 22 with respect to the substrate 24, and the oscillations of the Z direction component act so as to hit the electronic component 22 against the substrate 24. As a result, the electronic component 22, for example, in the case of a semiconductor chip component, damages the chip itself or an electrode film that has already been formed on the substrate.

Such oscillation mode of the standing wave strongly depends of the shape of the horn 50. Based on the results of a comprehensive research, the inventors have discovered a horn shape such that the amplitude of the Y direction component and the amplitude of the Z direction of the standing wave component become extremely small practically in the P3 position. Thus, the amplitude of the Y direction component and the amplitude of the Z direction of the standing wave become zero (or extremely close to zero) in the P3 position when the horn 50 has the cross-section variable section 54 and the cross-section variable section 54 has the following two specific features.

(1) In the position P3 corresponding to an anti-node of a standing wave of the oscillations excited in the horn 50, the sectional area $S_1$ of the first region A1 assumes a maximum and the sectional area $S_2$ of the second region A2 assumes a minimum.

(2) With the transition from the position P3 corresponding to an 5 anti-node of a standing wave of the oscillations excited in the horn 50 to the positions P2, P4 corresponding to nodes, the sectional area $S_1$ of the first region A1 decreases and the sectional area $S_2$ of the second region A2 increases.

Further, because the nozzle 56 holding the electronic component 22 is attached almost to the P3 position of the horn 50, oscillation components other than the oscillation component in the horizontal direction (that is, X direction) are not applied to the electronic component 22. On the other hand, in the oscillation mode of the standing wave of the horn of the conventional shape, the Y direction component and Z direction component of the standing wave in the P3 position are not sufficiently inhibited. As a result, strong oscillations are generated in the P3 position not only in the X direction, but also in the Y direction and Z direction. Thus, with the horn 50, oscillations of substantially only the oscillation component in the horizontal direction are applied to the electronic component 22 and good ultrasonic bonding of the electronic component 22 can be realized.

In addition, in the horn 50 such that the sectional area $S_2$ on the P2 side or P4 side position is larger than the sectional area $S_2$ of the second region A2 in the P3 position, the amplitude of ultrasonic oscillations from the oscillator 42 increases, the oscillations propagating in the P3 position have an amplitude equal to or larger than that generated by the oscillator 42, and the increase in the utilization efficiency of oscillations is realized. Furthermore, because the height $h_1$ of the first region A1 in the P3 position increases over the height $h_1$ in the positions on the P2 side or P4 side, the flexural rigidity of the horn 50 in the P3 position is effectively increased and the deflection of the horn 50 during ultrasonic bonding is significantly inhibited.

As described in detail hereinabove, in the above-described bonding apparatus 1 and horn unit 40, the component accommodated in the through hole 54*b* of the nozzle 56 is split tightened from the side of the side peripheral surface 56*c* in the direction (Y direction) perpendicular to the bonding direction of the nozzle 56 by combined action of the through hole 54*b*, slit 54*a*, and tightening screw 58B. Therefore, the nozzle 56 is strongly squeezed by the horn 50 and fixed with good stability. As a result, the nozzle 56 and horn 50 oscillate integrally and a good press attachment state can be realized. In addition, when a load is applied to the nozzle 56 during press attachment, because the press attachment direction (Z direction) and the tightening direction (Y direction) of the nozzle 56 are not the same direction, the tightening force practically does not affect the load during pressure attachment.

Furthermore, because the nozzle 56 can be detachably attached to the horn 50 by split tightening, the nozzle 56 can be fixed to the horn 50, without preparing separate components and the nozzle 56 can be replaced in a simple manner when the press attachment surface 56*b* is worn out. Moreover, since the nozzle 56 is not integrated with the horn 50, the nozzle 56 and horn 50 can be formed from different materials, and the nozzles with different length, shape, or shape/dimensions of the pressure attachment surface can be used according to applications.

Furthermore, in the horn unit 40, the pressure attachment surface 56*b* is so arranged that the central position of the pressure attachment surface 56*b* of the nozzle 56 assumes the position Q that is offset by ΔL from the position P3 corresponding to an anti-node of the standing wave of oscillations induced in the horn 50. Therefore, in the horn unit 40, the oscillation components in the Y direction and Z direction (termed hereinbelow as "first direction") in the pressure attachment surface 56*b* is inhibited with respect to that of the conventional horn units in which the pressure attachment surface is disposed in the position (P3) corresponding to an anti-node, and good pressure attachment state can be realized. Here, the aforementioned first direction is a direction perpendicular to the X direction, which is the direction of oscillations of the horn 50 induced by the oscillator 42, and this oscillation component becomes an oscillation component other than the X direction. Further, when the first direction is any of the Y direction and Z direction, the central position of the pressure attachment surface 56*b* of the nozzle 56 is offset to the position in which only any one oscillation component of the oscillation component in the Y direction and the oscillation component in the Z direction of the standing wave assumes a minimum.

The present invention is not limited to the above-described embodiment and various modifications thereof are possible. For example, the horn holder and horn of the horn unit may be appropriate separate components. Furthermore, a mode is possible in which the lower end surface of the cross-section variable section 54 serves as a pressure attachment nozzle, without employing the nozzle having a pressure attachment surface. Furthermore, in addition to a rectangular shape, the shape of the first region or second region may be an elliptical shape with the Z direction as a long-axis direction or a polygonal shape elongating and extending in the Z direction.

Figure 8:
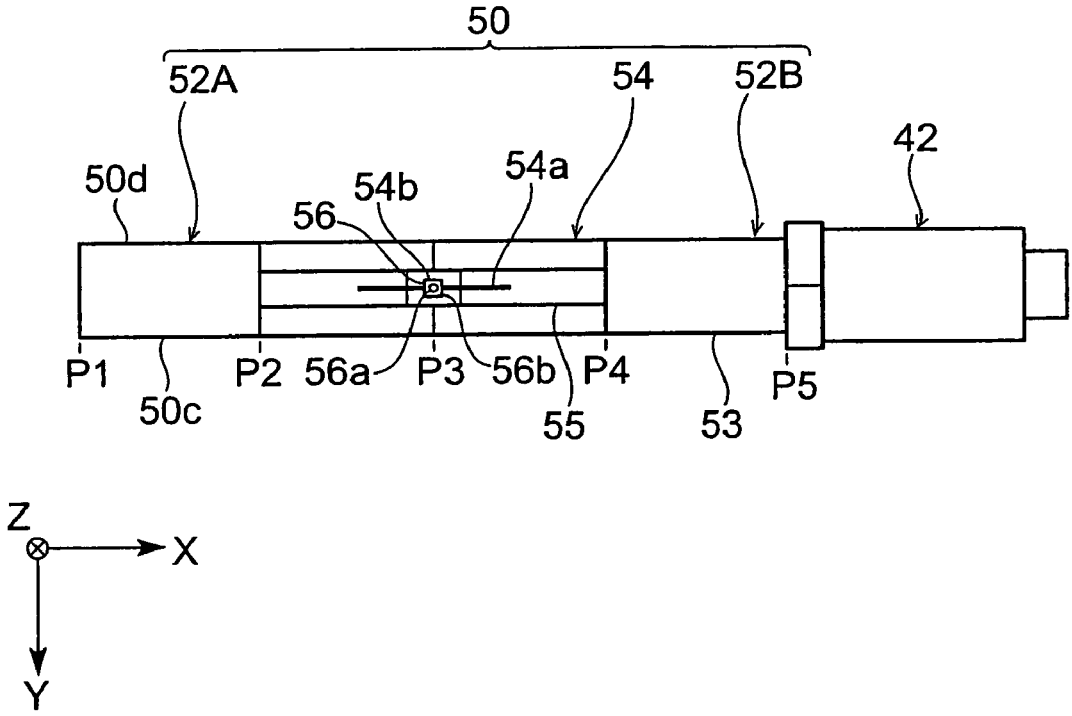
FIG. 8 is a bottom view illustrating a horn of a different embodiment.

Furthermore, as shown in FIG. 8, a mode is possible in which the through hole 54*b* in which the nozzle 56 is inserted is provided in the P3 position, and the central position of the pressure attachment surface 56*b* of the nozzle 56 matches the P3 position (thus, the offset length ΔL is zero). The nozzle accommodation hole may not pass through the horn.

Figure 9:
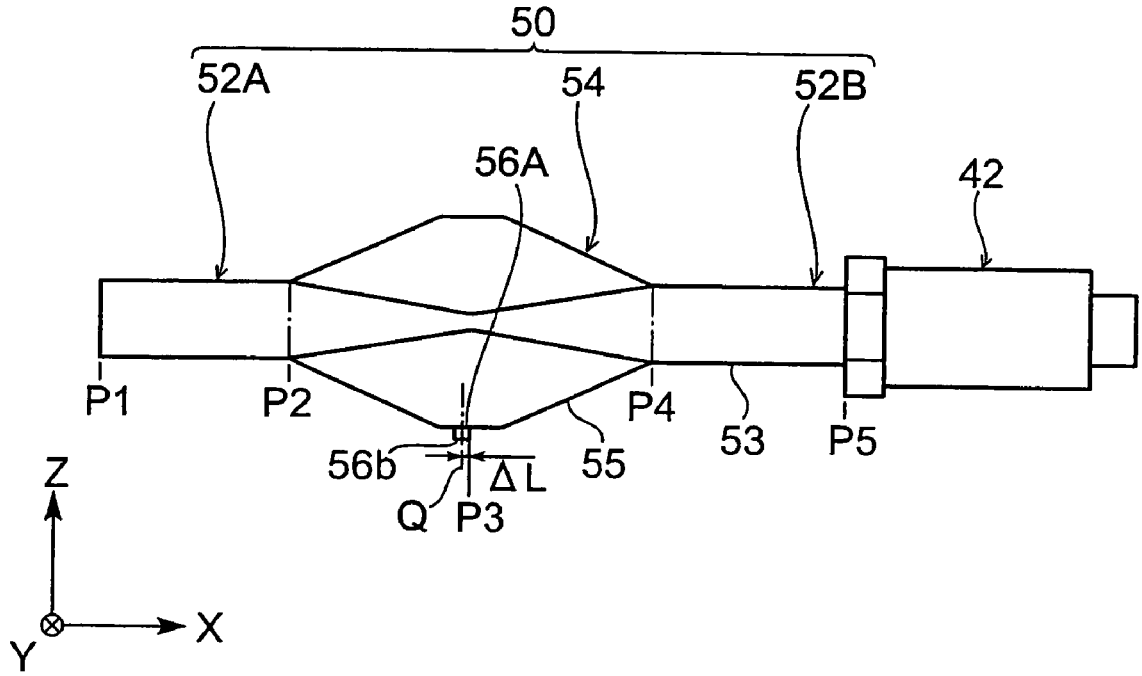
FIG. 9 is a side view illustrating a horn of a different embodiment.

Further, in another possible mode, as shown in FIG. 9, a horn is employed that has the protruding section 56A with the pressure attachment surface 56*b* formed on the lower surface thereof, instead of employing the nozzle 56 having the pressure attachment surface 56*b*. With the pressure attachment surface 56*b* on the horn, the central position of the pressure attachment surface 56*b* is also disposed in the position Q that is offset from the position P3 corresponding to the anti-node of the standing wave. Therefore, the effect identical to the above-described effect can be also obtained when this horn is employed.

The aforementioned horn unit comprises a horn to which oscillations are applied by an oscillator and which has a tin protruding section that protrudes from the main body section of the horn, a nozzle accommodation hole formed in the protruding section, a slit formed so as to cross the nozzle accommodation hole, and a tightening hole provided in the slit formation region, a pressure attachment nozzle accommodated in the nozzle accommodation hole of the horn, and fixing means for tightening and fixing the pressure attachment nozzle accommodated in the nozzle accommodation hole to the horn via the tightening hole. Therefore, the pressure attachment nozzle is accommodated in the nozzle accommodation hole formed so as to cross the slit and fixed to the horn with the fixing means via the tightening hole provided in the slit formation region. Thus, the pressure attachment nozzle is tightened and fixed (the so-called "split tightening") to the horn in the direction perpendicular to the pressure attachment direction by the combined action of the nozzle attachment hole, slit, and fixing means. In other words, because the horn squeezes the pressure attachment nozzle tightly from the side peripheral surface thereof, the pressure attachment nozzle is fixed to the horn with good stability.

Further, the bonding apparatus has the above-described horn unit, an oscillator for applying oscillations to the horn of the horn unit, and pressurization means for performing pressurization control in the pressure attachment direction of the pressure attachment of the horn unit, and because the bonding apparatus has the above-described horn unit, the pressure attachment nozzle is fixed to the horn with good stability.

Furthermore, oscillations are applied to the above-described horn by the oscillator, and the pressure attachment surface is disposed in a position that is offset from the position corresponding to the anti-node of the standing wave of oscillations excited in the horn. The inventors have discovered that when a horn is used in which the pressure attachment surface is disposed in a position that is offset from the position corresponding to the anti-node of the standing wave of oscillations excited in the horn, then the oscillation components in the directions other than the horizontal direction in the pressure attachment surface can be suppressed significantly by comparison with those in the case of the horn in which the pressure attachment surface is disposed in a position corresponding the anti-node. The offset position is preferably a position in which the oscillation component in the first direction crossing the oscillation direction of the horn under the effect of the oscillator assumes a minimum, and in this case, the oscillation component in the first direction is suppressed.

The above-described bonding apparatus comprises the above-described horn, an oscillator for applying oscillations to the horn, and pressurization means for performing pressurization control in the pressure attachment direction of the horn. Because the bonding apparatus has the above-described horn, the oscillation components in the directions other than the horizontal direction are suppressed.

Further, the above-described horn unit comprises a horn to which oscillations are applied by an oscillator, and a pressure attachment nozzle that has a pressure attachment surface and is attached to the horn so that the pressure attachment surface is disposed in a position that is offset from the position corresponding to an anti-node of the standing wave of oscillations excited in the horn. Here, the inventors have discovered that when a horn unit is used in which the pressure attachment surface of the pressure attachment nozzle is disposed in a position that is offset from the position corresponding to the anti-node of the standing wave of oscillations excited in the horn, then the oscillation components in the directions other than the horizontal direction in the pressure attachment surface can be suppressed significantly by comparison with those in the case of the horn unit in which the pressure attachment surface of the pressure attachment nozzle is disposed in a position corresponding to the anti-node. The offset position is preferably a position in which the oscillation component in the first direction crossing the oscillation direction of the horn under the effect of the oscillator assumes a minimum, and in this case, the oscillation component in the first direction is suppressed.

Further, the above-described bonding apparatus comprises the horn unit, an oscillator for applying oscillations to the horn of the horn unit, and pressurization means for performing pressurization control in the pressure attachment direction of the pressure attachment nozzle of the horn unit, and because the bonding apparatus has the above-described horn unit, oscillation components in the directions other than the horizontal direction are suppressed.

What is claimed is:

1. A horn to which oscillations are applied by an oscillator, comprising:

a portion in which a cross section perpendicular to a lengthwise direction of said horn has:

a first region extending in a first direction perpendicular to the lengthwise direction; and a pair of second regions sandwiching the first region in a second direction perpendicular to the first direction and the lengthwise direction, wherein a sectional area of the first region has a maximum displacement in the first direction and a sectional area of the second region has a minimum displacement in the first direction at a first position of the horn, the first position corresponding to an anti-node of a standing wave of oscillations excited in the horn, and wherein a transition of the sectional area of the first region decreases in the first direction from the first position to a second position along the lengthwise direction, and a transition of the sectional area of the second region in the first direction increases from the first position to the second position along the lengthwise direction, the second position corresponding to a node of the standing wave.

2. The horn according to claim 1, wherein the first region narrows in the first direction, whereby the sectional area of the first region decreases, and the second region expands in the first direction, whereby the sectional area of the second region increases.

3. A horn unit comprising:

a horn, to which oscillations are applied by an oscillator, comprising a portion in which a cross section perpendicular to a lengthwise direction of the horn has a first region extending in a first direction perpendicular to the lengthwise direction and a pair of second regions sandwiching the first region in a second direction perpendicular to the first direction and the lengthwise direction, wherein a sectional area of the first region has a maximum displacement in the first direction and a sectional area of the second region has a minimum displacement in the first direction at a first position of the horn, the first position corresponding to an anti-node of a standing wave of oscillations excited in the horn, and wherein a transition of the sectional area of the first region decreases in the first direction from the first position to a second position along the lengthwise direction, and a transition of the sectional area of the second region increases in the first direction from the first position to the second position along the lengthwise direction, the second position corresponding to a node of the standing wave; and a horn holder joined to the horn in the second position.

4. A bonding apparatus comprising:

an oscillator for applying oscillations to a horn;

a horn unit comprising said horn, to which oscillations are applied by said oscillator, comprising a portion in which a cross section perpendicular to a lengthwise direction of said horn has a first region extending in a first direction perpendicular to the lengthwise direction; and a pair of second regions sandwiching said first region in a second direction perpendicular to said first direction and the lengthwise direction, wherein a sectional area of the first region assumes a maximum displacement in the first direction and a sectional area of the second region assumes minimum displacement in the first direction at a first position of the horn, the first position corresponding to an anti-node of a standing wave of oscillations excited in the horn, and wherein a transition of the sectional area of the first region decreases in the first direction from the first position to a second position along the lengthwise direction, and a transition of the sectional area increases in the first direction, from the first position to the second position along the lengthwise direction, the second position corresponding to a node of the standing wave, and a horn holder joined to the horn in the second position; and pressurization means for performing pressurization control in the first direction.

* * * * *